US010259030B2

(12) United States Patent
Mikami et al.

(10) Patent No.: US 10,259,030 B2
(45) Date of Patent: Apr. 16, 2019

(54) SPINNING FORMING DEVICE

(71) Applicant: KAWASAKI JUKOGYO KABUSHIKI KAISHA, Kobe-shi, Hyogo (JP)

(72) Inventors: Kohei Mikami, Akashi (JP); Yoshihide Imamura, Kobe (JP); Yuto Sakane, Kobe (JP); Yoshiro Kabe, Kobe (JP); Hayato Iwasaki, Kobe (JP); Hiroshi Kitano, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 41 days.

(21) Appl. No.: 15/323,523

(22) PCT Filed: Jun. 24, 2015

(86) PCT No.: PCT/JP2015/003173
§ 371 (c)(1),
(2) Date: Jan. 3, 2017

(87) PCT Pub. No.: WO2016/002164
PCT Pub. Date: Jan. 7, 2016

(65) Prior Publication Data

US 2017/0144208 A1 May 25, 2017

(30) Foreign Application Priority Data

Jul. 2, 2014 (JP) ..... 2014-136697

(51) Int. Cl.
*B21D 22/18* (2006.01)
*B21D 22/14* (2006.01)
(Continued)

(52) U.S. Cl.
CPC ..... *B21D 22/18* (2013.01); *B21D 22/14* (2013.01); *B21D 37/16* (2013.01); *H05B 6/102* (2013.01)

(58) Field of Classification Search
CPC ..... B21D 22/14; B21D 22/16; B21D 22/18; B21D 37/16; H05B 6/102
See application file for complete search history.

(56) References Cited

U.S. PATENT DOCUMENTS 3,815,395 A 6/1974 Sass
4,976,126 A * 12/1990 Yamamoto ..... B21D 22/16 72/81
(Continued)

FOREIGN PATENT DOCUMENTS

CN 202192168 U 4/2012
EP 0081700 A1 6/1983
(Continued)

OTHER PUBLICATIONS

Aug. 4, 2015 International Search Report issued in International Patent Application No. PCT/JP2015/003173.
(Continued)

*Primary Examiner* — Pradeep C Battula
(74) *Attorney, Agent, or Firm* — Oliff PLC

(57) ABSTRACT

A spinning forming device includes: a rotating shaft that rotates a plate to be formed; a processing tool that presses a front surface of the plate while being moved outward in a radial direction of the rotating shaft; and a heater that is moved so as to be located on the same circumference as the processing tool and locally heats the plate by induction heating. The spinning forming device further includes a cooling device that cools the front surface of the plate.

7 Claims, 9 Drawing Sheets

(51) Int. Cl.
*B21D 37/16* (2006.01)
*H05B 6/10* (2006.01)

(56) References Cited

U.S. PATENT DOCUMENTS

| | | | | |
|---|---|---|---|---|
| 5,235,837 | A * | 8/1993 | Werner | B21D 22/18 72/69 |
| 6,561,001 | B2 * | 5/2003 | Sakuma | B21D 22/14 72/370.14 |
| 9,545,932 | B1 * | 1/2017 | Stancescu | B21D 22/185 |
| 2001/0039864 | A1 * | 11/2001 | Yoshitome | B21D 22/14 83/13 |
| 2015/0202677 | A1 * | 7/2015 | Ogishi | B21D 22/18 72/19.1 |

FOREIGN PATENT DOCUMENTS

| | | | |
|---|---|---|---|
| JP | S48-041965 | A | 6/1973 |
| JP | H07-223645 | A | 8/1995 |
| JP | 2003-334626 | A | 11/2003 |
| JP | 2011-218427 | A | 11/2011 |

OTHER PUBLICATIONS

Aug. 4, 2015 Written Opinion issued in International Patent Application No. PCT/JP2015/003173.
Dec. 4, 2017 Office Action issued in Chinese Patent Application No. 2015800197173.

* cited by examiner

SPINNING FORMING DEVICE

TECHNICAL FIELD

The present invention relates to a spinning forming device for forming a plate in a desired shape while rotating the plate.

BACKGROUND ART

Conventionally known is a spinning forming device designed to transform a plate by pressing a processing tool against the plate while rotating the plate. The spinning forming device normally includes a mandrel (shaping die) attached to a rotating shaft and performs forming in such a manner that the plate is pressed against the mandrel by the processing tool.

In recent years, proposed is a spinning forming device designed to perform spinning forming while locally heating the plate. For example, as a spinning forming device for a titanium alloy, PTL 1 discloses a spinning forming device configured such that a portion of the plate which is pressed against the mandrel by a spatula (processing tool) is heated by high frequency induction heating.

CITATION LIST

Patent Literature

PTL 1: Japanese Laid-Open Patent Application Publication No. 2011-218427

SUMMARY OF INVENTION

Technical Problem

The inventors of the present invention have found that when the processing tool is pressed against a surface of the plate while being moved outward in a radial direction, a protrusion is formed outside a portion of the surface of the plate against which portion the processing tool is pressed. This protrusion significantly occurs especially when the plate is thick. This is because when the plate is thick, the amount of heat input to the plate is large, and pressing force of the processing tool against the plate is high. Such protrusion may become a spiral shape like shavings as the forming proceeds.

An object of the present invention is to provide a spinning forming device capable of suppressing a protrusion of a plate.

Solution to Problem

To solve the above problem, a spinning forming device of the present invention includes: a rotating shaft that rotates a plate to be formed; a processing tool that presses a front surface of the plate while being moved outward in a radial direction of the rotating shaft; a heater that is moved so as to be located on a same circumference as the processing tool and locally heats the plate by induction heating; and a cooling device that cools the front surface of the plate.

According to the above configuration, since the front surface against which the processing tool is pressed is cooled, a reduction of yield strength of the front surface of the plate can be suppressed. As a result, the protrusion of the plate can be suppressed.

The spinning forming device may be configured such that: the heater is disposed at a position that does not overlap the processing tool when viewed from an axial direction of the rotating shaft; and the cooling device cools the front surface of the plate at a position upstream of the processing tool and downstream of the heater in a rotational direction of the plate. According to this configuration, in a state in which the effect of the cooling is maintained only in the vicinity of the front surface heated by the heater to an appropriate temperature, that is, before the effect of the cooling proceeds from the front surface to an inside of the plate, the plate can be deformed by the processing tool. Thus, the plate can be formed satisfactorily.

For example, the cooling device may be configured to spray a cooling agent toward the front surface of the plate or may be configured to apply a cooling agent to the front surface of the plate. Or, the cooling device may include a cooling roller that contacts the front surface of the plate.

The spinning forming device may be configured such that: the processing tool is a forming roller; and the cooling device is attached to the heater or a supporting member which is supporting the forming roller. According to this configuration, the cooling device can be moved together with the processing tool or the heater. As a result, the cooling device can be configured as a compact device that performs local cooling.

The spinning forming device may be configured such that: the forming roller is formed in a shape having a trapezoidal cross section that decreases in diameter in a direction away from the rotating shaft; and a center axis of the forming roller is set such that a large-diameter portion of the forming roller is in point contact with the plate, and an angle between a side surface of the forming roller and the radial direction of the rotating shaft is not less than 1° and not more than 30°. According to this configuration, the protrusion of the plate can be suppressed while restricting, by the side surface of the forming roller, warp-up of a portion of the plate which portion is located outside a position against which the processing tool is pressed.

The above spinning forming device may further include a receiving jig attached to the rotating shaft and supporting a central portion of the plate, wherein the heater may be constituted by at least one of a rear-side heater disposed so as to face a rear surface of the plate and a front-side heater disposed so as to face the front surface of the plate. For example, in a case where the heater is constituted by both the rear-side heater and the front-side heater, the plate can be formed satisfactorily even if the plate is thick.

Advantageous Effects of Invention

According to the present invention, the protrusion of the plate can be suppressed.

DESCRIPTION OF EMBODIMENTS

Embodiment 1

Figure 1:
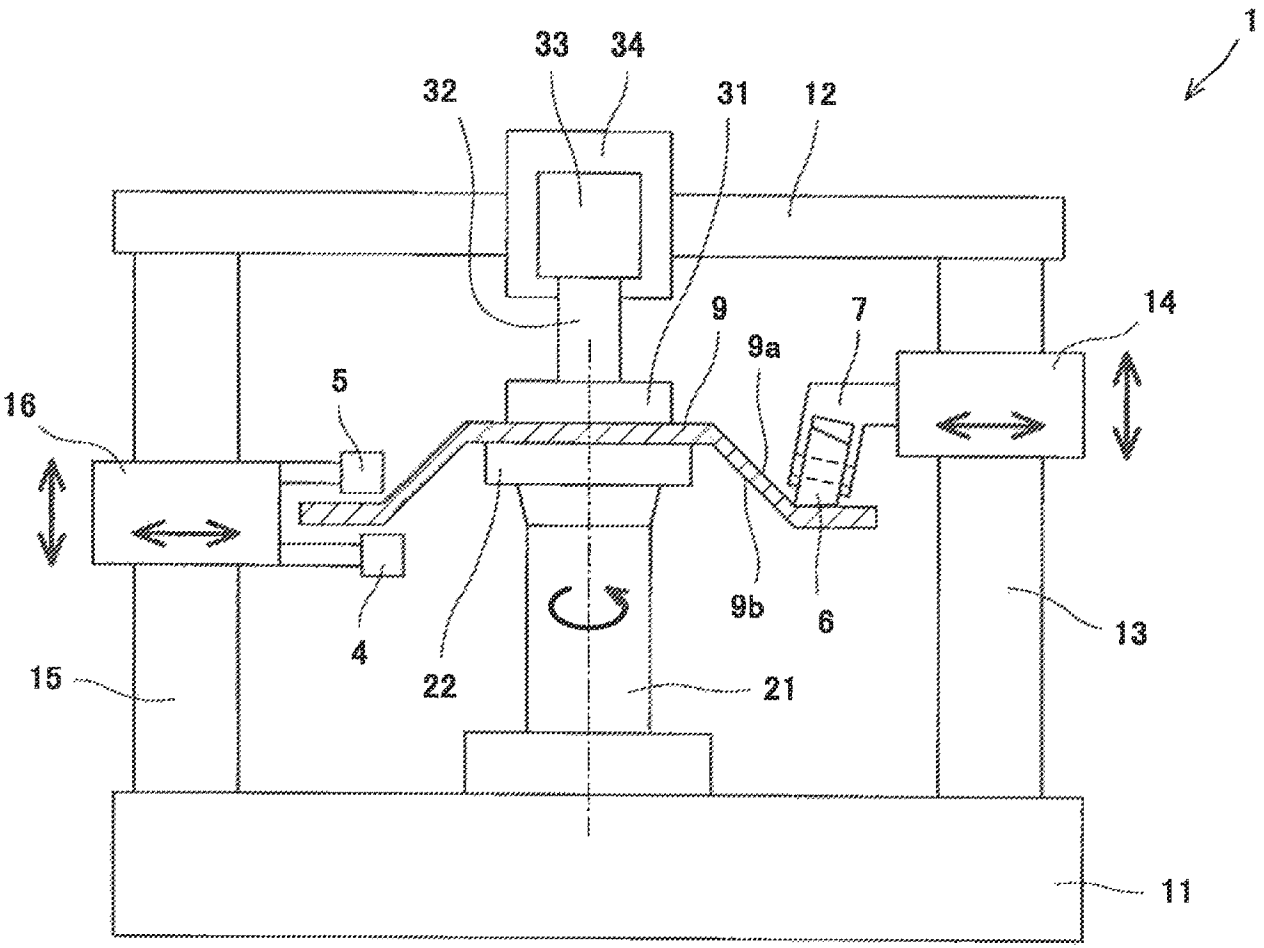
FIG. 1 is a schematic configuration diagram of a spinning forming device according to Embodiment 1 of the present invention.

FIG. 1 shows a spinning forming device 1 according to Embodiment 1 of the present invention. The spinning forming device 1 includes: a rotating shaft 21 that rotates a plate 9 to be formed; a receiving jig 22 interposed between the rotating shaft 21 and the plate 9; and a fixing jig 31. The receiving jig 22 is attached to the rotating shaft 21 and supports a central portion of the plate 9. The fixing jig 31 sandwiches the plate 9 together with the receiving jig 22. The spinning forming device 1 further includes: a rear-side heater 4 disposed at a rear side of the plate 9; and a front-side heater 5 and a processing tool 6 which are disposed at a front side of the plate 9.

An axial direction of the rotating shaft 21 is a vertical direction in the present embodiment. However, the axial direction of the rotating shaft 21 may be a horizontal direction or an oblique direction. A lower portion of the rotating shaft 21 is supported by a base 11. The rotating shaft 21 is rotated by a motor, not shown. An upper surface of the rotating shaft 21 is flat, and the receiving jig 22 is fixed to the upper surface of the rotating shaft 21.

The plate 9 is, for example, a flat circular plate. However, the shape of the plate 9 may be a polygonal shape or an oval shape. The plate 9 is not necessarily flat over the entirety. For example, the central portion of the plate 9 may be thicker than a peripheral edge portion of the plate 9, or the entire plate 9 or a part of the plate 9 may be processed in advance to have a tapered shape. A material of the plate 9 is not especially limited and is, for example, a titanium alloy.

In the present embodiment, a front surface 9*a* of the plate 9 is an upper surface, and a rear surface 9*b* of the plate 9 is a lower surface. The rear side heater 4 is disposed under the plate 9. The front-side heater 5 and the processing tool 6 are disposed above the plate 9. It should be noted that the front surface 9*a* of the plate 9 may be the lower surface, the rear surface 9*b* of the plate 9 may be the upper surface, the rear-side heater 4 may be disposed above the plate 9, and the front-side heater 5 and the processing tool 6 may be disposed under the plate 9.

The receiving jig 22 has a size within a circle defined by a forming start position of the plate 9. For example, in a case where the receiving jig 22 has a disc shape, a diameter of the receiving jig 22 is equal to or smaller than a diameter of the circle defined by the forming start position of the plate 9. Unlike conventional mandrels, the plate 9 is not transformed by being pressed against a radially outer side surface of the receiving jig 22.

The fixing jig 31 is attached to a pressurizing rod 32. The pressurizing rod 32 is rotatably supported by a supporting portion 33. The supporting portion 33 is driven by a driving portion 34 in an upward/downward direction. The driving portion 34 is attached to a frame 12 disposed above the rotating shaft 21. It should be noted that the fixing jig 31 may be omitted, and the plate 9 may be directly fixed to the receiving jig 22 by, for example, bolts.

The processing tool 6 presses the front surface 9*a* of the plate 9 while being moved outward in a radial direction of the rotating shaft 21. In the present embodiment, used as the processing tool 6 is a forming roller that rotates following the rotation of the plate 9. However, the processing tool 6 is not limited to the forming roller and may be, for example, a spatula.

More specifically, the processing tool 6 is supported by a supporting member 7. The processing tool 6 is moved in the radial direction of the rotating shaft 21 by a first radial direction movement mechanism 14 through the supporting member 7 and is also moved in an axial direction of the rotating shaft 21 by a first axial direction movement mechanism 13 through the radial direction movement mechanism 14 and the supporting member 7. The first axial direction movement mechanism 13 extends so as to be a crosslink between the base 11 and the frame 12.

The rear-side heater 4 is disposed so as to face the rear surface 9*b* of the plate 9, and the front-side heater 5 is disposed so as to face the front surface 9*a* of the plate 9. These heaters 4 and 5 locally heat the plate 9 by induction heating and are moved so as to be located on the same circumference as the processing tool 6. This expression "on the same circumference" denotes that heating centers of the heaters 4 and 5 and a center of the processing tool 6 are located within a ring-shaped range defined around a central axis of the rotating shaft 21 and having a certain width.

More specifically, the heaters 4 and 5 are moved in the radial direction of the rotating shaft 21 by a second radial direction movement mechanism 16 and are also moved in the axial direction of the rotating shaft 21 by a second axial direction movement mechanism 15 through the radial direction movement mechanism 16. The second axial direction movement mechanism 15 extends so as to be a crosslink between the base 11 and the frame 12.

For example, a displacement meter (not shown) that measures a distance to the plate 9 is attached to at least one of the rear-side heater 4 and the front-side heater 5. The rear-side heater 4 and the front-side heater 5 are moved in the axial direction and radial direction of the rotating shaft 21 such that a measured value of the displacement meter is kept constant.

Relative positions of the heaters 4 and 5 and the processing tool 6 in a circumferential direction of the rotating shaft 21 are not especially limited. For example, the heaters 4 and 5 may be disposed at respective positions that are right opposite to the processing tool 6 across the rotating shaft 21 or may be disposed at respective positions that are displaced from the above positions that are right opposite to the processing tool 6 across the rotating shaft 21 (for example, at respective positions that are away from the processing tool 6 by 90° in the circumferential direction of the rotating shaft 21). In the present embodiment, the rear-side heater 4 and the front-side heater 5 are disposed at respective positions that do not overlap the processing tool 6 when viewed from the axial direction of the rotating shaft 21 and face each other in the axial direction of the rotating shaft 21.

Figure 2:
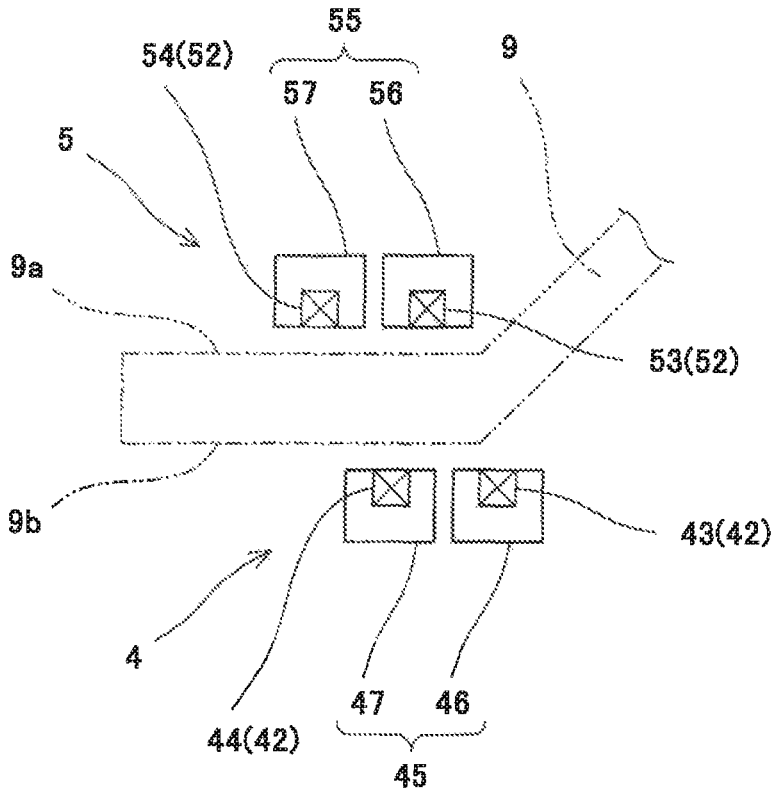
FIG. 2 is a cross-sectional view showing a rear-side heater and a front-side heater.
Figure 3B:
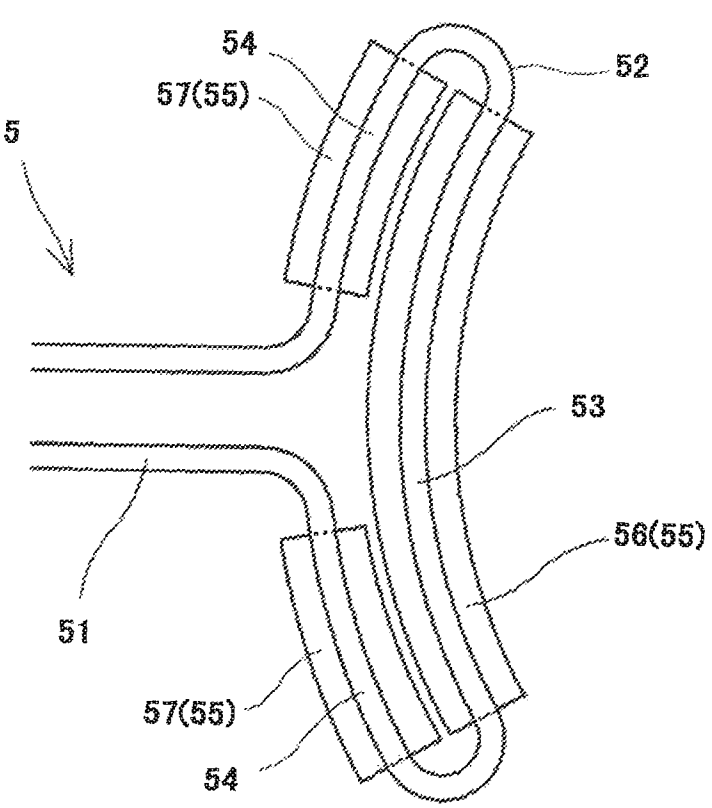
FIG. 3B is a bottom view of the front-side heater.
Figure 3A:
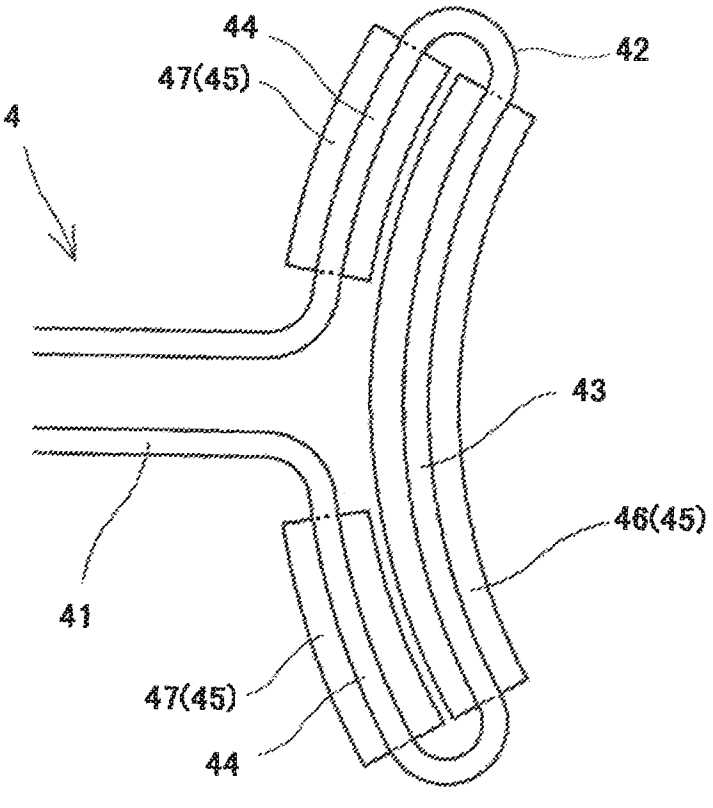
FIG. 3A is a plan view of the rear-side heater.

As shown in FIGS. 2 and 3A, the rear-side heater 4 includes: an electric conducting pipe 41 including a coil portion 42; and a core 45 that collects magnetic flux generated around the coil portion 42. A cooling liquid flows through the electric conducting pipe 41. The coil portion 42 has a doubled circular-arc shape that extends in a rotational direction of the plate 9 and faces the plate 9. An opening angle (angle between both end portions) of the coil portion 42 is, for example, 60° to 120°. The core 45 is constituted by: one inner peripheral piece 46 that covers an inner circular-arc portion 43 of the coil portion 42 from an opposite side of the plate 9; and two outer peripheral pieces 47 that cover respective outer circular-arc portions 44 of the coil portion 42 from the opposite side of the plate 9.

Similarly, as shown in FIGS. 2 and 3B, the front-side heater 5 includes: an electric conducting pipe 51 including a coil portion 52; and a core 55 that collects magnetic flux generated around the coil portion 52. The cooling liquid flows through the electric conducting pipe 51. The coil portion 52 has a doubled circular-arc shape that extends in the rotational direction of the plate 9 and faces the plate 9. The opening angle (angle between both end portions) of the coil portion 52 is, for example, 60° to 120°. The core 55 is constituted by: one inner peripheral piece 56 that covers an inner circular-arc portion 53 of the coil portion 52 from the opposite side of the plate 9; and two outer peripheral pieces 57 that cover respective outer circular-arc portions 54 of the coil portion 52 from the opposite side of the plate 9.

As described above, since each of the rear-side heater 4 and the front-side heater 5 includes the coil portion (42 or 52) that extends in the rotational direction of the plate 9, the local heating of the plate 9 can be performed continuously in the rotational direction of the plate 9. With this, excellent formability can be obtained. It should be noted that each of the rear-side heater 4 and the front-side heater 5 does not necessarily have to include the coil portion (42 or 52) having the doubled circular-arc shape. For example, one or each of the rear-side heater 4 and the front-side heater 5 may include a plurality of circular coil portions arranged in a circular-arc shape or may include only one circular coil portion.

An alternating voltage is applied to the electric conducting pipe 41 of the rear-side heater 4 and the electric conducting pipe 51 of the front-side heater 5. A frequency of the alternating voltage is not especially limited but is desirably a high frequency of 5 k to 400 kHz. To be specific, the induction heating performed by the rear-side heater 4 and the front-side heater 5 is desirably high frequency induction heating.

Figure 4B:
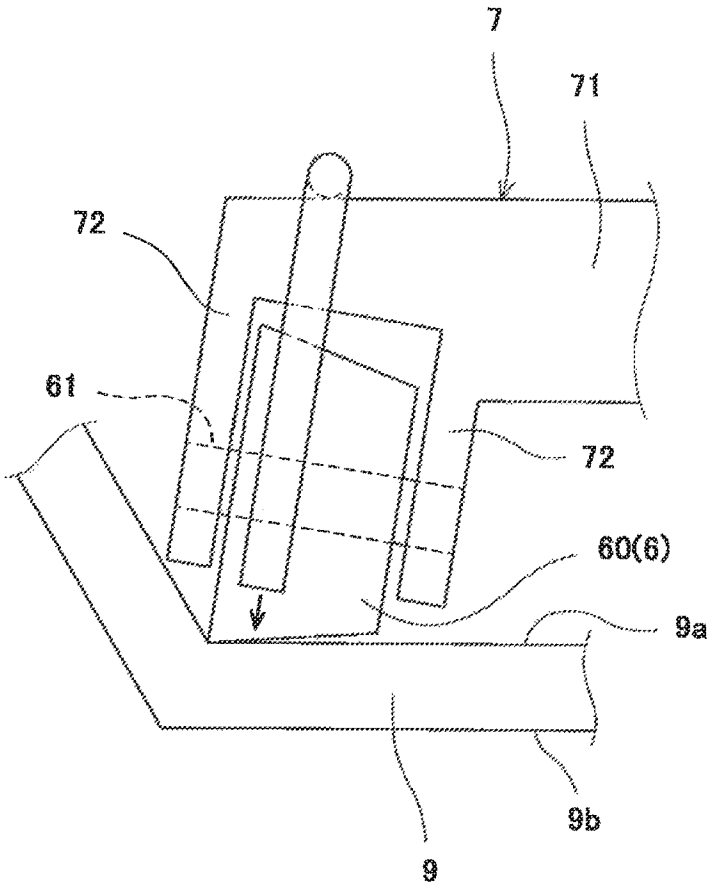
FIG. 4B is a side view showing the cooling device in Embodiment 1.
Figure 4A:
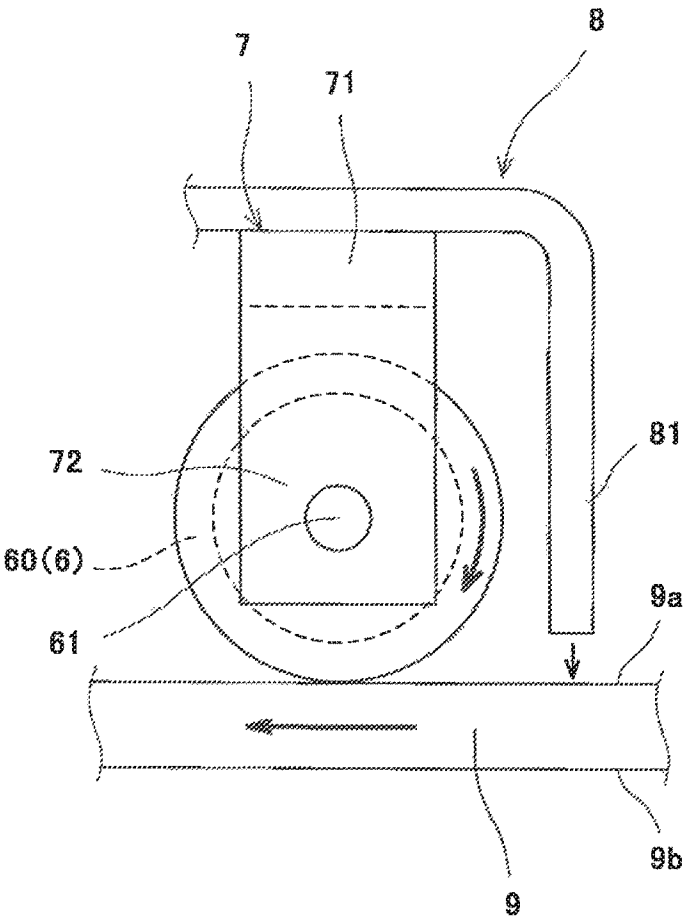
FIG. 4A is a front view showing a cooling device in Embodiment 1.

Next, the components around the processing tool 6 will be explained in detail in reference to FIGS. 4A and 4B. In the present embodiment, a cooling device 8 that cools the front surface 9*a* of the plate 9 is attached to the supporting member 7 that supports the processing tool 6. The cooling device 8 is not shown in FIG. 1 for simplicity.

In the present embodiment, a forming roller 60 as the processing tool 6 is formed in a shape having a trapezoidal cross section that decreases in diameter in a direction away from the rotating shaft 21. To be specific, the forming roller 60 includes: a large-diameter bottom surface located close to the rotating shaft 21; a small-diameter top surface located at the opposite side of the rotating shaft 21; and a tapered side surface connecting the bottom surface and the top surface. To be specific, a corner portion between the side surface and the bottom surface is a large-diameter portion, and a corner portion between the side surface and the top surface is a small-diameter portion.

A center axis of the forming roller 60 is set such that: the large-diameter portion of the forming roller 60 is in point contact with the plate 9; and an angle between the side surface of the forming roller 60 and the radial direction of the rotating shaft 21 is not less than 1° and not more than 30°. In the present embodiment, the forming roller 60 is slightly inclined outward in the radial direction of the rotating shaft 21 such that the top surface of the forming roller 60 is not perpendicular to the radial direction of the rotating shaft 21 but faces obliquely downward. However, the center axis of the forming roller 60 may be parallel to the radial direction of the rotating shaft 21 or may be inclined opposite to FIG. 4B.

The supporting member 7 rotatably supports the forming roller 60 through a rotating shaft 61 and bearings (not shown). To be specific, the center axis of the forming roller 60 coincides with a center line of the rotating shaft 61.

Specifically, the supporting member 7 includes: a main body 71 extending in the radial direction of the rotating shaft 21; and a pair of projecting pieces 72 projecting obliquely downward from the main body 71 so as to face the respective top and bottom surfaces of the forming roller 60. Both end portions of the rotating shaft 61 are supported by the respective projecting pieces 72. The bearings (not shown) may be interposed between the rotating shaft 61 and the forming roller 60 (the rotating shaft 61 does not rotate) or may be interposed between the rotating shaft 61 and the projecting piece 72 (the rotating shaft 61 rotates).

The cooling device 8 cools the front surface 9*a* of the plate 9 at a position upstream of the forming roller 60 and downstream of the rear-side heater 4 and the front-side heater 5 in the rotational direction of the plate 9. In the present embodiment, the cooling device 8 is configured to spray a cooling agent toward the front surface 9*a* of the plate 9.

Specifically, the cooling device 8 includes an injection pipe 81 that injects the cooling agent toward the front surface 9*a* of the plate 9. The injection pipe 81 is supplied with the cooling agent from a supply device (not shown). The injection pipe 81 is fixed to the main body 71 of the supporting member 7.

The cooling agent may be any of a gas, a liquid, and powder. Examples of the cooling agent in the form of the gas include air, carbon dioxide, and nitrogen. Examples of the cooling agent in the form of the liquid include water and oil. If the cooling agent in the form of the liquid or powder having lubricity is used, a lubricating effect between the forming roller 60 and the plate 9 can be expected.

For example, when the plate 9 is made of a titanium alloy (such as Ti-6Al-4V), the plate 9 is heated by the rear-side heater 4 and the front-side heater 5 to 900° C. to 950° C. At this time, it is desirable that the cooling device 8 cool the front surface 9*a* of the plate 9 such that the temperature of the front surface 9*a* does not become lower than 750° C. This is because if the temperature of the front surface 9*a* becomes lower than 750° C., deformation resistance of the vicinity of the front surface 9*a* of the plate 9 drastically increases.

As explained above, in the spinning forming device 1 of the present embodiment, since the front surface 9*a* against which the processing tool 6 is pressed is cooled by the cooling device 8, a reduction of yield strength of the front surface 9*a* of the plate 9 can be suppressed. As a result, a protrusion 91 formed outside a portion of the front surface 9*a* against which portion the processing tool 6 is pressed as shown in FIG. 5 can be suppressed.

Figure 5:
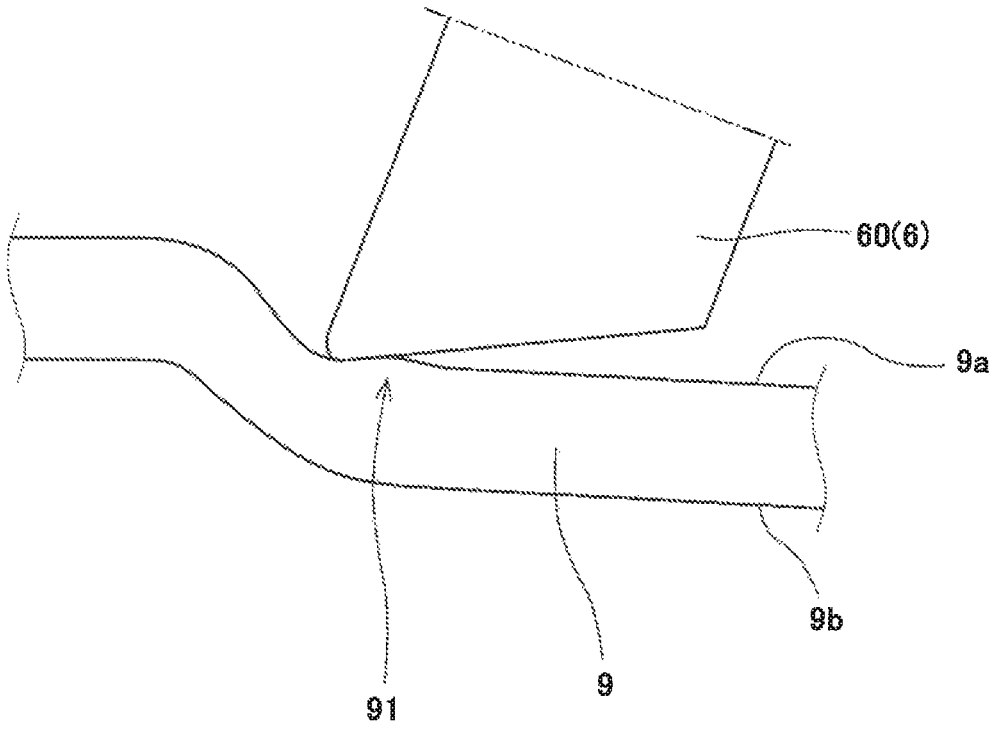
FIG. 5 is a cross-sectional view showing a protrusion of a plate.

As shown in FIG. 5, a portion of the plate 9 which portion is located outside a position against which the processing tool 6 is pressed may be inclined downward. To suppress such deformation of the plate 9, for example, it is desirable that a peripheral portion of the rear surface 9*b* of the plate 9 be supported by a roller or the like.

In contrast, the portion of the plate 9 which portion is located outside the position against which the processing tool 6 is pressed may warp up toward the forming roller 60. In this case, the forming roller 60 having a trapezoidal cross section is used, and the center axis of the forming roller 60 is set as in the present embodiment. With this, the protrusion 91 of the plate 9 can be suppressed while restricting the warp-up of the above portion of the plate 9 by the side surface of the forming roller 60.

In the present embodiment, the cooling device 8 cools the front surface 9*a* of the plate 9 at the position upstream of the forming roller 60 and downstream of the heaters 4 and 5. With this configuration, in a state in which the effect of the cooling is maintained only in the vicinity of the front surface 9*a* heated by the heaters 4 and 5 to an appropriate temperature, that is, before the effect of the cooling proceeds from the front surface 9*a* to an inside of the plate 9, the plate 9 can be deformed by the processing tool 6. Thus, the plate 9 can be formed satisfactorily.

In the present embodiment, since the cooling device 8 is attached to the supporting member 7 of the processing tool 6, the cooling device 8 can be moved together with the processing tool 6. As a result, the cooling device 8 can be configured as a compact device that performs local cooling. Further, when the cooling device 8 is attached to the supporting member 7, for example, the injection pipe 81 is provided with a branch pipe, and a tip end of the branch pipe is directed to the forming roller 60. With this, the forming roller 60 can also be cooled by utilizing the cooling device 8.

Modified Example

In the above embodiment, both the rear-side heater 4 and the front-side heater 5 are used. However, only one of the rear-side heater 4 and the front-side heater 5 may be used. For example, if only the front-side heater 5 is used, a mandrel having a side surface as a forming surface for the plate may be used instead of the receiving jig 22. However, the plate 9 can be satisfactorily formed by using both the rear-side heater 4 and the front-side heater 5 even if the plate 9 is thick.

A cross-sectional shape of the forming roller 60 may be any other shape, such as a substantially diamond shape, a long round shape, or a rectangular shape with round corners, depending on conditions of the forming of the plate 9.

Embodiment 2

Figure 6:
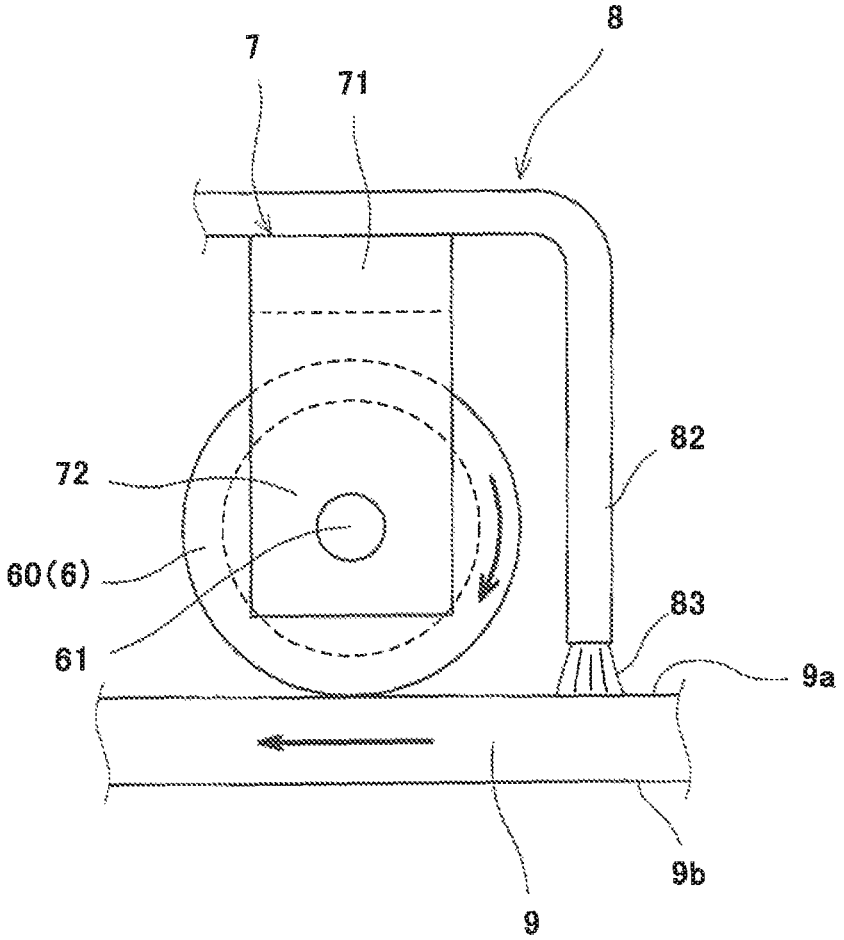
FIG. 6 is a front view showing the cooling device in Embodiment 2 of the present invention.

Next, the spinning forming device according to Embodiment 2 of the present invention will be explained in reference to FIG. 6. It should be noted that only the configuration of the cooling device 8 is different between the spinning forming device of the present embodiment and the spinning forming device 1 of Embodiment 1. Therefore, only the cooling device 8 will be explained below (the same applies to Embodiments 3 to 5 below).

In the present embodiment, the cooling device 8 is configured to apply the cooling agent to the front surface 9*a* of the plate 9 at a position upstream of the forming roller 60 and downstream of the heaters 4 and 5. Further, in the present embodiment, the cooling device 8 is attached to the supporting member 7 for the processing tool 6.

Specifically, the cooling device 8 includes: a brush 83 that contacts the front surface 9*a* of the plate 9; and a supply pipe 82 that supplies the cooling agent in the form of the liquid or the powder to the brush 83. The supply pipe 82 is fixed to the main body 71 of the supporting member 7.

The present embodiment can obtain the same effects as Embodiment 1.

Embodiment 3

Figure 7:
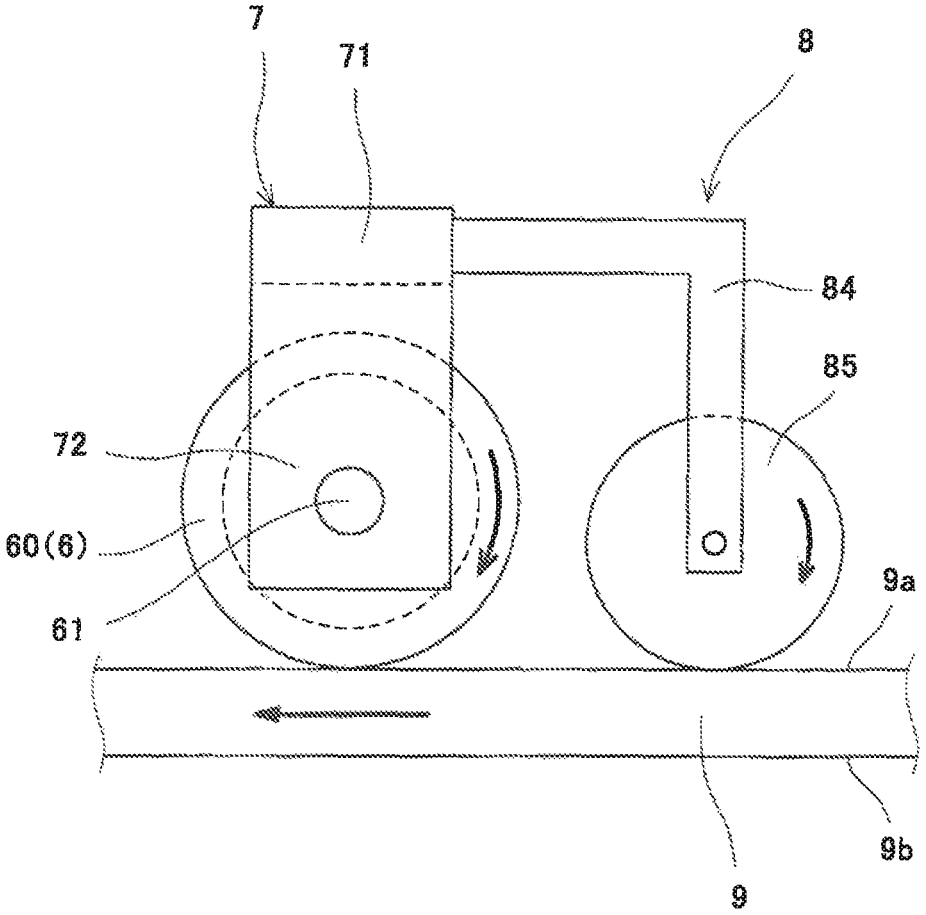
FIG. 7 is a front view showing the cooling device in Embodiment 3 of the present invention.

Next, the spinning forming device according to Embodiment 3 of the present invention will be explained in reference to FIG. 7. In the present embodiment, the cooling device 8 includes a cooling roller 85. Further, in the present embodiment, the cooling device 8 is attached to the supporting member 7 of the processing tool 6.

The cooling roller 85 is disposed at a position upstream of the forming roller 60 and downstream of the heaters 4 and 5. The cooling roller 85 contacts the front surface 9*a* of the plate 9 to rotate following the rotation of the plate 9. The cooling roller 85 is rotatably supported by an arm 84, and the arm 84 is fixed to the main body 71 of the supporting member 7.

The cooling roller 85 is made of metal or heat-resistant resin. For example, a flow path through which a heat medium flows is formed in the cooling roller 85, and an outward flow path through which the heat medium is supplied to the flow path of the cooling roller 85 and a return flow path through which the heat medium is retrieved from the flow path of the cooling roller 85 are formed in the arm 84. Examples of the heat medium include gases, such as air, carbon dioxide, and nitrogen, and liquids, such as water and oil.

The present embodiment can obtain the same effects as Embodiment 1.

Embodiment 4

Figure 8:
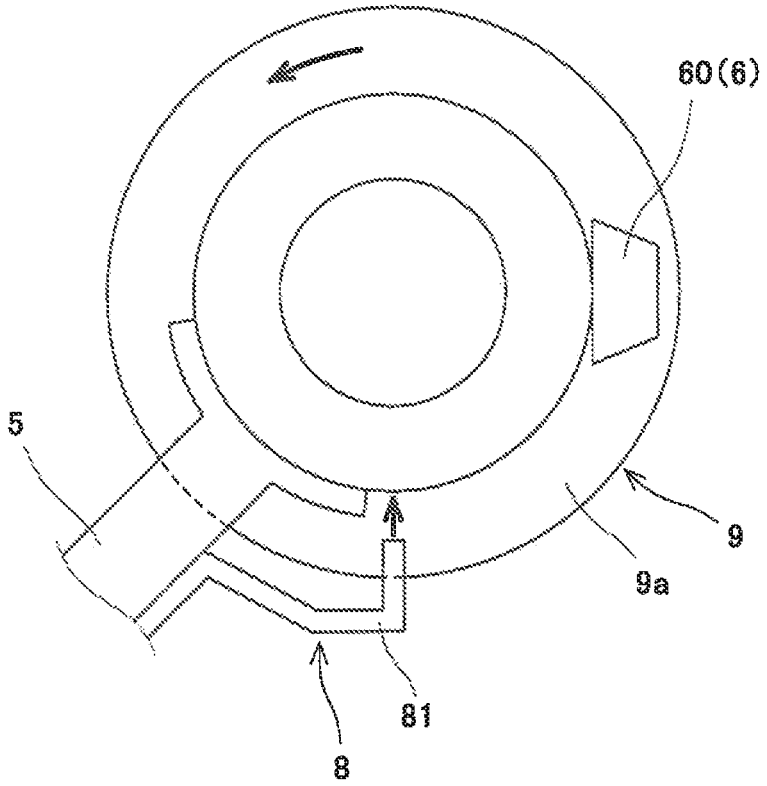
FIG. 8 is a plan view showing the cooling device in Embodiment 4 of the present invention.

Next, the spinning forming device according to Embodiment 4 of the present invention will be explained in reference to FIG. 8. In the present embodiment, the cooling device 8 is attached to the front-side heater 5. However, the cooling device 8 may be attached to the rear-side heater 4.

In the present embodiment, as with Embodiment 1, the cooling device 8 includes the injection pipe 81 that injects the cooling agent toward the front surface 9*a* of the plate 9 and cools the front surface 9*a* of the plate 9 at the position upstream of the forming roller 60 and downstream of the heaters 4 and 5. However, the cooling device 8 may include the brush 83 and the supply pipe 82 as with Embodiment 2 or may include the cooling roller 85 as with Embodiment 3.

The present embodiment can obtain the same effects as Embodiment 1. Further, in the present embodiment, since the cooling device 8 is attached to the front-side heater 5, the cooling device 8 can be moved together with the heaters 4 and 5. As a result, the cooling device 8 can be configured as a compact device that performs local cooling.

Embodiment 5

Figure 9:
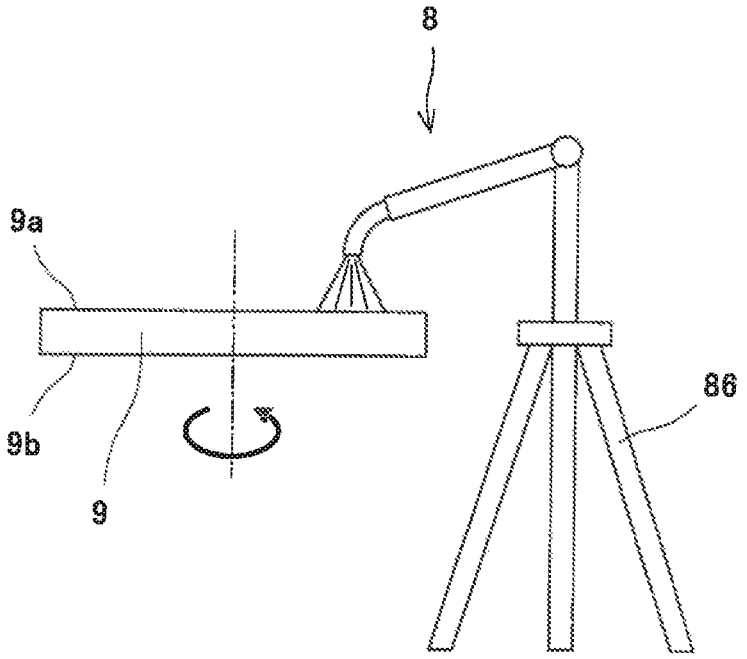
FIG. 9 is a side view showing the cooling device in Embodiment 5 of the present invention.

The spinning forming device according to Embodiment 5 of the present invention will be explained in reference to FIG. 9. In the present embodiment, the cooling device 8 that cools the front surface 9*a* of the plate 9 is supported by a stand 86 provided on a ground surface.

The present embodiment can obtain the same effects as Embodiment 1. In the present embodiment, a position cooled by the cooling device 8 is fixed. Therefore, it is desirable that the cooling device 8 cool a range that is wide to some extent.

INDUSTRIAL APPLICABILITY

The present invention is useful when performing spinning forming of plates made of various materials.

REFERENCE SIGNS LIST

1 spinning forming device
21 rotating shaft
22 receiving jig
4 rear-side heater
5 front-side heater
6 processing tool
60 forming roller
7 supporting member
8 cooling device
85 cooling roller
9 plate
9*a* front surface
9*b* rear surface

The invention claimed is:

1. A spinning forming device comprising:
a rotating shaft that rotates a plate to be formed;
a processing tool that presses a front surface of the plate while being moved outward in a radial direction of the rotating shaft;
a heater that is moved so as to be located on a same circumference as the processing tool and locally heats the plate by induction heating; and
a cooler that cools the front surface of the plate, wherein:
the heater is disposed at a position that does not overlap the processing tool when viewed from an axial direction of the rotating shaft; and
the cooler cools the front surface of the plate at a position upstream of the processing tool and downstream of the heater in a rotational direction of the plate.

2. The spinning forming device according to claim 1, wherein the cooler is configured to spray a cooling agent toward the front surface of the plate.

3. The spinning forming device according to claim 1, wherein the cooler is configured to apply a cooling agent to the front surface of the plate.

4. The spinning forming device according to claim 1, wherein the cooler includes a cooling roller that contacts the front surface of the plate.

5. The spinning forming device according to claim 1, wherein:
the processing tool is a forming roller; and
the cooler is attached to the heater or a supporting member supporting the forming roller.

6. The spinning forming device according to claim 1, further comprising a receiving jig attached to the rotating shaft and supporting a central portion of the plate, wherein
the heater is constituted by at least one of a rear-side heater disposed so as to face a rear surface of the plate and a front-side heater disposed so as to face the front surface of the plate.

7. A spinning forming device comprising:
a rotating shaft that rotates a plate to be formed;
a forming roller that presses a front surface of the plate while being moved outward in a radial direction of the rotating shaft;
a heater that is moved so as to be located on a same circumference as the forming roller and locally heats the plate by induction heating; and
a cooler that cools the front surface of the plate, wherein:
the forming roller is formed in a shape having a trapezoidal cross section that decreases in diameter in a direction away from the rotating shaft; and
a center axis of the forming roller is set such that a large-diameter portion of the forming roller is in point contact with the plate, and an angle between a side surface of the forming roller and the radial direction of the rotating shaft is not less than 1° and not more than 30°.

* * * * *